United States Patent [19]

Lamprey

[11] Patent Number: 4,529,062

[45] Date of Patent: Jul. 16, 1985

[54] ELEVATOR SYSTEM

[76] Inventor: Donald F. Lamprey, 114 Glenwood Dr., Liverpool, N.Y. 13088

[21] Appl. No.: 422,731

[22] Filed: Sep. 24, 1982

[51] Int. Cl.[3] ..... B66B 9/00

[52] U.S. Cl. ..... 187/1 R; 187/94

[58] Field of Search ..... 187/1 R, 17, 94, 95, 187/2; 191/22 R, 23 R

[56] References Cited

U.S. PATENT DOCUMENTS

| | | | |
|---|---|---|---|
| 1,978,273 | 10/1934 | Lundberg et al. | 187/1 R |
| 3,707,205 | 12/1972 | Gibson | 187/1 R |
| 3,741,351 | 6/1973 | Suozzo | 187/95 |
| 3,885,773 | 5/1975 | Dunkelberger | 187/95 |
| 4,043,430 | 8/1977 | Kraft et al. | 187/1 R |
| 4,222,140 | 9/1980 | Olewinski et al. | 187/94 |

*Primary Examiner*—Joseph J. Rolla

*Assistant Examiner*—Kenneth Noland

*Attorney, Agent, or Firm*—Bruns and Wall

[57] ABSTRACT

An elevator system that includes a pair of tubular guide rails that are positioned forward of the center of gravity of the elevator car. One of the hollow rail members contains electrical wiring for servicing elevator control and indicator circuits while the other rail member slidably contains a counterweight that is attached to the car to reduce the amount of energy required to raise and lower the car. Placing the guide rails so as to favor the front or door side of the car provides for shorter electrical conduit runs and also allows the rails and the stiles of the car frame to be superimposed within the hoistway thereby saving a considerable amount of space. The car frame is also formed of hollow tubular members in which is contained the electrical service to the cab.

5 Claims, 5 Drawing Figures

58
16
66
65

32
30
31
19
52
53
54

58
57
58
19
18
10
14
16
66
14
13
65
15
35
35
15
11
12
-20-
35
17
27
29
26
25

ELEVATOR SYSTEM

BACKGROUND OF THE INVENTION

This invention relates to an improvement in elevators and, in particular, to an improvement in hydraulically operated elevators.

Historically, all types of elevator systems have utilized heavy T-shaped beams for guide rails which serve to direct the elevator car along a vertical path of travel as it is raised or lowered in the hoistway. In the case of a cable operated system, the rails also serve as an important part of the emergency braking system. In the event of an overspeed condition, automatically actuated brakes mounted upon the car engage the rails and bring the car to controlled safe stops. In order to minimize bending or distortion of the rails during both normal and emergency operations, it has been found advantageous to place the rails within a vertical plane that passes through the center of gravity of the car. This, however, places the rails outside of the stiles which form the structural side members making up part of the elevator car frame. The hoistway must accordingly be relatively wide to accommodate the laterally juxtaposed members.

In order to conserve valuable shaft space, the stiles are typically formed of outwardly facing channels and the T-rails are situated inside the channel openings. Although this "wrap-around" construction saves space, it nevertheless requires that the elevator car be assembled in the field rather than being prefabricated in the shop and shipped as a unit to the point of installation. Field assembly seriously limits the amount of flexibility that can be used in the design and construction of elevator cars.

With the introduction of more sophisticated electrical controls and signalling devices, it has also been found that elevator hoistways are becoming exceedingly crowded with electrical wiring. Oftentimes the wiring is randomly dispersed throughout the shaft making it extremely difficult to trace. The wiring also poses a hazard not only to equipment but also to anyone forced to work in the shaft.

In the last twenty-five years or so, the hydraulic elevator has gained a great deal of popularity, particularly in regard to use in smaller buildings that are under ten stories high. In this type of system, the car assembly is attached directly to the piston of a hydraulic lifting cylinder and the piston, rather than cables, serves to raise and lower the car. Because the piston supports the entire weight of the car, there is no practical reason to place the guide rails at the center of gravity of the car. This practice, however, still persists. Furthermore, most hydraulically operated elevators operate without the benefit of counterweights. The hydraulic system therefore must provide the energy necessary to both lift and brake the car along with its cargo. Accordingly, a good deal of potentially recoverable energy is wasted or dissipated as heat in the hydraulics.

SUMMARY OF THE INVENTION

It is therefore an object of the present invention to improve elevator systems and, in particular, hydraulically operated elevator systems.

A further object of the present invention is to compact the amount of hoistway space required by an elevator.

A still further object of the present invention is to provide for greater flexibility in the design and construction of an elevator system.

Another object of the present invetion is to save energy in elevator systems using hydraulically operated lifts.

Yet another object of the present invention is to provide a compact counterweight in hydraulically operated elevator systems.

Still another object of the present invention is to minimize the amount of space required by the electrical and mechanical components in the hoistway of an elevator shaft.

A further object of the present invention is to eliminate the need to assemble an elevator car frame in the field.

Another object of the present invention is to reduce the installation cost associated with elevator systems.

These and other objects of the present invention are attained by means of an elevator system that includes a car unit arranged to be raised and lowered within a hoistway or shaft, a pair of hollow guide rails positioned in the shaft on either side of the car that are forward of the car frame whereby the rails are superimposed with the stiles of the car frame, guides acting between the car and rails for directing the car along a vertical path of travel within the shaft, electrical wiring for servicing control and signalling devices relating to the operation of the elevator is stored in one of said hollow rails, outlets for connecting the wiring to control and signalling equipment stationed along the length of the rail, a counterweight slidably mounted within the other rail and being connected to the car by means of a wire rope and sheave mechanism is a manner that is designed to considerably reduce the amount of energy required to raise the car.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figures 1, 3, 4:
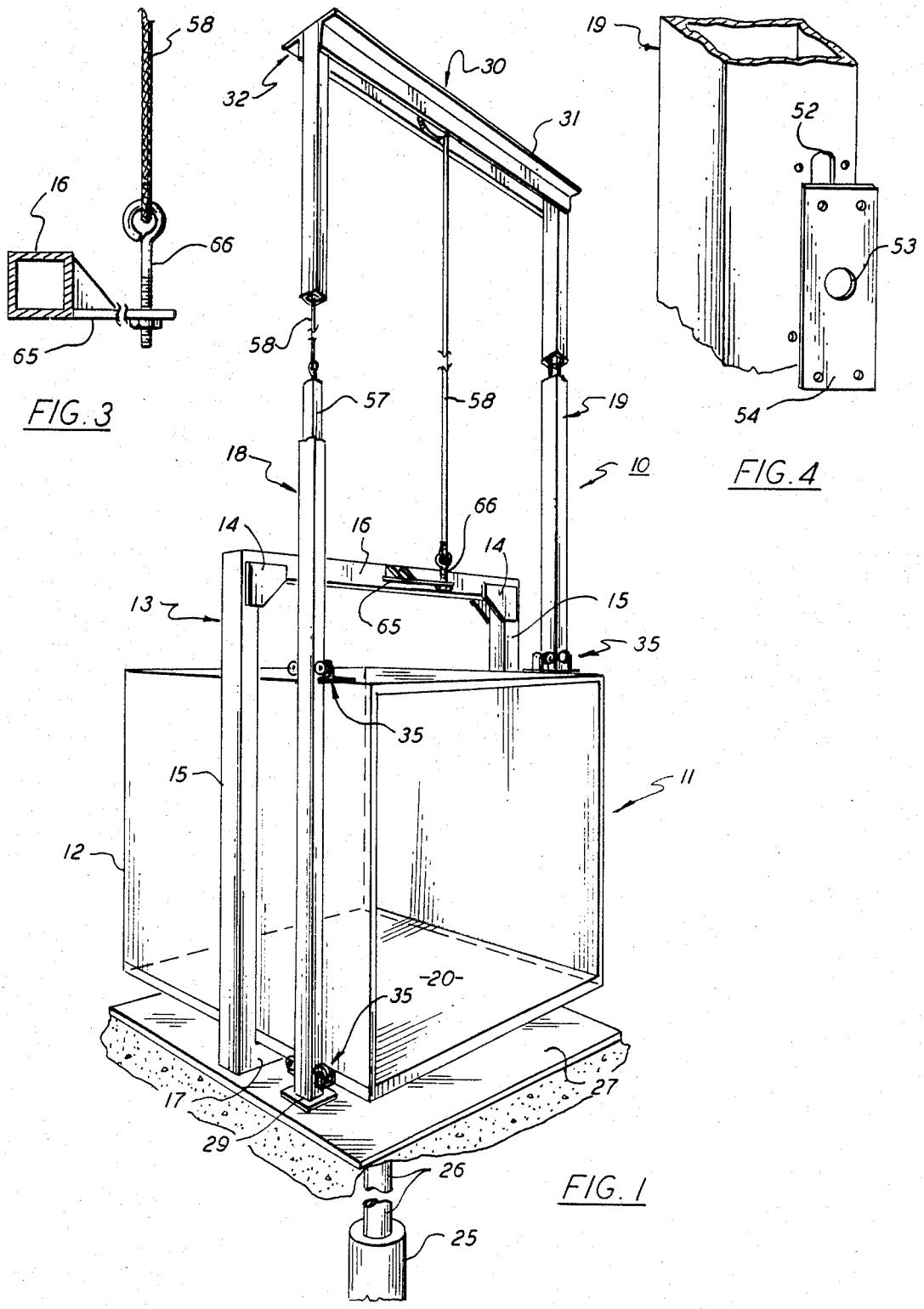
FIG. 1 is a perspective view of a hydraulically operated elevator system that embodies the teachings of the present invention.
FIG. 3 is a sectional view taken through the upper crosshead of the car frame showing the attachment for the counterweight mechanism utilized in the present system.
FIG. 4 is an enlarged view in perspective showing a coverplate and access opening provided in one of the guide rails.

Referring now to the drawings, there is illustrated in FIG. 1 an elevator system generally referenced 10 which embodies the teachings of the present invention. The system contains a car unit 11 that includes a generally enclosed cab 12 which is surrounded by a centrally positioned rectangular frame or superstructure 13. Although not shown, the open front side of the car normally houses one or more doors. The doors are adapted to open and close automatically to permit people and cargo to pass into and out of the car when it is brought to a desired duty station which, in most cases, will be a selected floor of a building. The door end of the car will herein be referred to as the front of the elevator.

Figure 2:
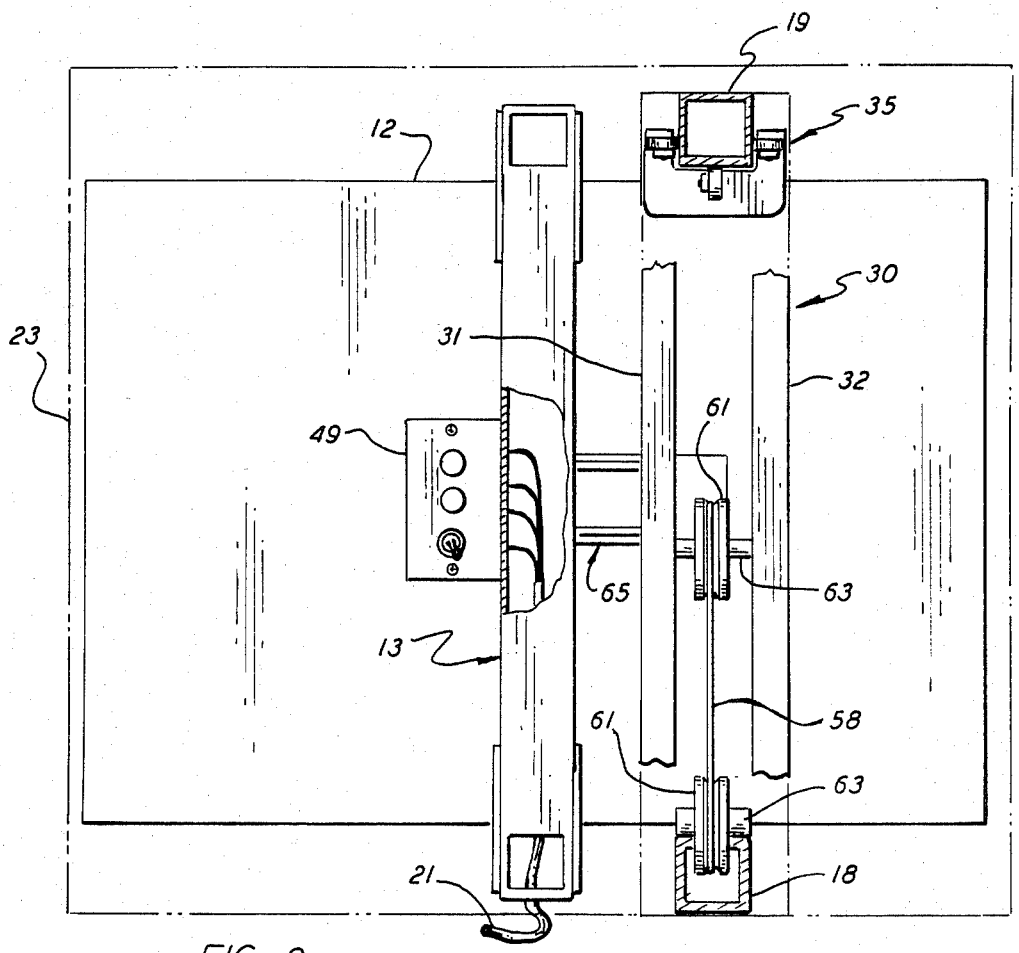
FIG. 2 is a top plan view of the elevator system shown in FIG. 1 with portions broken away to more clearly illustrate the guide rail arrangement utilized therein.

The car frame 13 is made up of four structural members that are cojoined in assembly as by welding. Gusset plates 14—14 are also provided at the corners to of the frame further strengthen the assembly. The frame members consist of two vertical side risers or stiles 15—15, an upper horizontal crosshead 16 and a lower horizontal plank or bolster 17. The deck or platform 20 of the car rests upon and is secured to the bolster with the car extending symmetrically to the front and rear of the frame as shown in FIGS. 1 and 2. As is conventional in the art, the frame is generally situated in a vertical plane that passes through the center of gravity of the car. Accordingly, the car is well balanced inside the frame.

As noted above, the car frame of the elevator has heretofore been constructed of heavy structural members such as channels, I-beams and angles. In the previously mentioned wraparound construction, where the guide rails are aligned in the plane of the frame, the stiles are invariably formed of channels that wrap around the adjacent guide rail. As a consequence of this wrapped construction, the elevator car must be assembled at the construction site and thus the many advantages normally associated with prefabrication cannot be realized. As will be explained in greater detail below, the guide rails 18, 19 employed in the present system are moved well forward of the stiles and as a result, the stiles no longer have to be wrapped or otherwise inextricably associated with the rails. The elements making up the structural member of the present car frame are hollow rectangular beams which serve to reduce the overall weight of the unit without sacrificing strength or load carrying capacity. As best shown in FIG. 2, electrical service to the cab is brought into the hollow frame by means of a travelling cable or harness 21. The harness is carried through the hollow superstructure to various cab related circuits such as door operators, cab lights and fan, position indicators, door switches and the like. A portion of the harness 21 is carried to the top of the car and operatively connected to the inspection station 49. It should be further noted that because the stiles are not wrapped about the rails, the prefabricated car assembly can be installed as a unit in the shaft with comparative ease.

Raising and lowering the car within the elevator shaft, the boundaries of which are shown by phantom outline 23 in FIG. 2, is accomplished by means of a hydraulic cylinder 25 acting through a piston 26. In practice the piston passes upwardly through the foundation 27 of the shaft and is secured to the plank 17 of the car frame. The hydraulic cylinder serves as a lifting and supporting device to raise and lower the car to a desired elevation. The piston is generally centered about the center of gravity of the car thereby minimizing the effects of bending moments upon the lifting and support systems.

As can be seen, with a hydraulic operated elevator there is no necessity to have the stiles wrap about the guide rails as the supporting load is taken up by the hydraulic system. The guide rails utilized in the present invention are brought forward of the guide frame. The rails are thus superimposed in front of the stiles thereby considerably reducing the width required of the shaft and, as noted above, providing for ease of installation of the prefabricated car unit.

Figure 5:
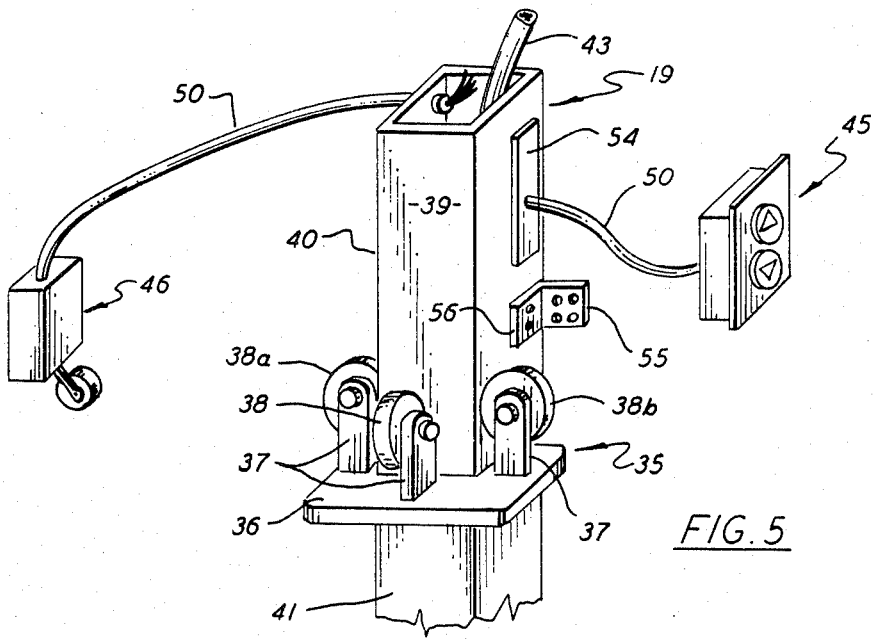
FIG. 5 is also an enlarged view in perspective further showing the construction of a guide rail utilized in the present invention.

In assembly each rail is securely anchored in the shaft foundation using anchor plates 29 or any other suitable means for holding the rails in a vertical or upright position. Each rail runs along one side wall of the shaft to the top thereof where the rails are cojoined by a cross member 30 formed by two angles 31 and 32 fastened to the opposing front and rear faces of the rails. Here again, the two rails are formed of hollow rectangular shaped beams. Each rail is operatively connected to the car by one or more three wheel carriages that are generally referenced 35 in the drawings. Each carriage includes a mounting plate 36, that is affixed to the car frame by any suitable means, and three wheel brackets 37—37 that rotatably support the carriage wheels as best illustrated in FIG. 5. The center wheel 38 is arranged to ride in rolling contact with the front wall 39 of the rail while the two outer wheels **38*a* and 38*b* ride in contact with opposed side walls 40 and 41 of the rail. In assembly, the two outer wheels ride against only the front part of the side walls 40 and 41** thereby leaving the back part of the wall surfaces free for other purposes.

Electrical wires or conduit such as line 43 (FIG. 5) are pass through the follow rail 19 and serve to carry electrical service to function related devices, such as call button station 45 and limit switch 46. Other types of signalling and/or control devices that might be similarly tied into the rail include door interlocks, call acknowledgment lights, arrival lanterns and gongs, floor selectors, levelling switches, pit stop switches, and special service switches and the like. As illustrated in FIGS. 4 and 5, access lines 50 are carried out of the rail 19 through wide vertical access slots 52. In assembly, each access line is passed through a more restrictive hole 53 formed in a cover plate 54 and the plate is secured to the side wall of the rail, as for example by screws.

Wall brackets, such as bracket 55, are secured to the back of each rail. The brackets are spaced at intervals along each rail to stabilize the rails in the shaft. Here again the rail embracing flanges 56 of each bracket are positioned back on the rails so they will not interfere with the carriage as it moves along the length of the rail.

A counterweight 57 (FIG. 1) is slidably contained within the opposite guide rail 18 and is attached to the crosshead 16 of the elevator car frame by means of a wire rope 58. The wire rope is trained over a pair of idler sheaves 61 rotatably mounted between the angles 31 a nd 32 that make up the cross member 30 of the rail system. The sheaves are each supported by shafts 63—63 suspended between the angles so that the sheaves turn freely in response to the movement of the wire rope. The car end of the rope is attached to the car frame by means of a laterally extended mounting plate 65 and an eye bolt 66 to which the rope 58 is spliced (FIG. 3). The plate 65 extends laterally a sufficient distance to permit rope 58 to hang vertically from sheave 61. Sheave 61 is further positioned in the cross member so that the vertically extended portion of the rope hanging therefrom is generally aligned along the vertical axis of the car. Accordingly, the load exerted upon the rope is minimized as the car is raised or lowered in the shaft. As should be evident, the present counterbalance system is substantially enclosed within one of the guide rails to provide for a clean and uncluttered hoistway.

While this invention has been described with reference to the embodiment herein disclosed, it should be evident that the present invention is broad enough to cover any modifications that come within the scope of the following claims.

I claim:

1. Elevator apparatus that is arranged to move within a vertical hoistway between duty stations that includes a car movably contained within the hoistway, a lifting frame secured about the outside of the car that includes opposed stiles which pass vertically along the sidewalls of the car, said frame being positioned within a vertical plane that passes through the center of gravity of the car whereby the car is balanced within said frame, one of said opposed stiles receiving electrical conductors for operating various car related circuits, a pair of hollow guide rails vertically disposed in said hoistway in front of said stiles, said rails being aligned with said stiles along the sidewalls of the car so that the rails and stiles are situated one behind the other within the hoistway whereby the amount of usable space within the hoistway is maximized, guide means acting between the body of the car and the rails for guiding the car along a vertical path of travel as it moves within the hoistway, electrical means passing through at least one of said hollow guide rails for bringing electrical conductors to terminal means located at the duty station, drive means connected to the frame for raising and lowering the car within said hoistway, a counterweight slidably contained within the other of said hollow guide rails, and a single pulley means carrying a rope for suspending the counterweight from the top of said frame to offset the weight of the car, and a horizontal bracket secured between the upper ends of the rails, and means for suspending said single pulley means centrally in said bracket.

2. The apparatus of claim 1 that further includes a counterweight slidably contained within the other of said hollow guide rails and a pulley means carrying a rope for suspending the counterweight from the top of said frame to offset the weight of the car.

3. The apparatus of claim 2 that further includes a horizontal bracket secured between the upper ends of the rails and means for suspending said pulley means in said bracket.

4. The apparatus of claim 1 wherein said drive means further includes a hydraulic lifting means connected to the bottom of said frame for raising and lowering said car.

5. The apparatus of claim 1 wherein said frame is constructed of hollow members.

* * * * *